US006550536B2

(12) United States Patent
Bernat

(10) Patent No.: US 6,550,536 B2
(45) **Date of Patent: *Apr. 22, 2003**

(54) DOWNHOLE COILED TUBING RECOVERY APPARATUS

(76) Inventor: Henry A. Bernat, 4426 Tibbs, Shreveport, LA (US) 71106

( * ) Notice: Subject to any disclaimer, the term of this patent is extended or adjusted under 35 U.S.C. 154(b) by 0 days.

This patent is subject to a terminal disclaimer.

(21) Appl. No.: 10/081,829

(22) Filed: Feb. 25, 2002

(65) Prior Publication Data

US 2002/0092651 A1 Jul. 18, 2002

Related U.S. Application Data

(62) Division of application No. 09/577,172, filed on May 23, 2000, now Pat. No. 6,464,014.

(51) Int. Cl.[7] ..... E21B 31/00
(52) U.S. Cl. ..... 166/301; 166/177
(58) Field of Search ..... 166/301, 177.6, 166/178, 104

(56) References Cited

U.S. PATENT DOCUMENTS

| | | | |
|---|---|---|---|
| 2,340,959 | A | 2/1944 | Harth |
| 2,641,927 | A | 6/1953 | Grable |
| 2,730,176 | A | 1/1956 | Herbold |
| 2,972,380 | A | 2/1961 | Bodine |
| 3,168,140 | A | 2/1965 | Bodine |
| 3,189,106 | A | 6/1965 | Bodine |
| 3,339,646 | A | 9/1967 | Bodine |
| 3,500,908 | A | 3/1970 | Barler |
| 4,119,297 | A | 10/1978 | Gunther |
| 4,366,988 | A | 1/1983 | Bodine |
| 4,429,743 | A | 2/1984 | Bodine |
| 4,448,250 | A | 5/1984 | Cooke, Jr. et al. |
| 4,574,888 | A | 3/1986 | Vogen |
| 4,576,229 | A | 3/1986 | Brown |
| 4,585,061 | A | 4/1986 | Lyons, Jr. et al. |
| 4,621,688 | A | 11/1986 | Bodine |
| 4,673,037 | A | 6/1987 | Bodine |
| 4,788,467 | A | 11/1988 | Plambeck |
| 5,040,598 | A | 8/1991 | Pleasants |
| 5,040,926 | A | 8/1991 | Andreasson |
| 5,180,012 | A | 1/1993 | Crawford |
| 5,180,014 | A | 1/1993 | Cox |
| 5,184,682 | A | 2/1993 | Delacour |
| 5,234,056 | A | 8/1993 | Bodine et al. |
| 5,735,351 | A | 4/1998 | Helms |

FOREIGN PATENT DOCUMENTS

| | | |
|---|---|---|
| FR | 0395167 | 10/1990 |

*Primary Examiner*—Frank S. Tsay
(74) *Attorney, Agent, or Firm*—John M. Harrison

(57) ABSTRACT

A downhole coiled tubing recovery apparatus and method which utilizes vibration and resonant vibration in particular, to remove coiled tubing and/or other objects which are stuck or jammed downhole in a well. In a preferred embodiment the coiled tubing recovery apparatus includes an oscillating apparatus suspended from a rig and fitted with a coiled tubing bail for mounting the coiled tubing and the method includes guiding the coiled tubing from a reel through the bail and into and from an injector head and the well, responsive to raising and lowering of the oscillating apparatus and the tubing bail. One or more rod clamps are typically used in connection with the coiled tubing bail for manipulating the coiled tubing through the injector head to and from the reel. In another embodiment of the invention the coiled tubing bail is omitted and the coiled tubing is suspended directly from a fitting attached to the oscillator and extends through the injector head into the well.

20 Claims, 4 Drawing Sheets

DOWNHOLE COILED TUBING RECOVERY APPARATUS

This application is a divisional application of U.S. application Ser. No. 09/577,172, filed May 23, 2000, and now U.S. Pat. No. 6,464,014.

BACKGROUND OF THE INVENTION

FIELD OF THE INVENTION

This invention relates to the freeing of stuck or jammed tubulars or other objects downhole and more particularly, to a downhole coiled tubing recovery apparatus and method designed to utilize a resonant frequency oscillator in combination with a specially designed coiled tubing bail for directing coiled tubing directly from a tubing reel through an injector head and to and from the well responsive to raising and lowering of the oscillator and the tubing bail. Freeing of the tubulars or objects is accomplished by typically resonance vibration of the bail and coiled tubing by operation of the oscillator.

Oil field tubulars such as well liners, casing, tubing and drill pipe stuck in a well bore due to various downhole conditions have been one of the principal sources of problems for oil operators and have expanded the business activity of fishing service companies in this century. During this period of time, many new and innovative tools and procedures have been developed to improve the success and efficiency of fishing operations. Apparatus such as electric line free point tools, string shot assisted backoff, downhole jarring tools, hydraulic-actuated tools of various types and various other tools and equipment have been developed for the purpose of freeing stuck or jammed tubulars downhole in a well. Although use of this equipment has become more efficient with time, the escalation in cost of drilling and workover operations has resulted in a proliferation of stuck pipe, liners, casing, and the like downhole, frequently leading to well abandonment as the most expedient resolution of the problem.

The use of vibration and resonant vibration in particular, as a means of freeing stuck tubulars from a well bore has the potential to be immediately effective and thus greatly and drastically reduce the cost involved in tubular recovery operations. Resonance occurs in vibration when the frequency of the excitation force is equal to the natural frequency of the system. When this happens, the amplitude (or stroke) of vibration will increase without bound and is governed only by the degree of damping present in the system.

A resonant vibrating system will store a significant quantity of energy, much like a flywheel. The ratio of the energy stored to the energy dissipated per cycle is referred to as the systems "Q". A high energy level allows the system to transfer energy to a given load at an increased rate, much like an increase in voltage will allow a flashlight to burn brighter with a given bulb. Only resonant systems will achieve this energy buildup and exhibit the corresponding efficient energy transmission characteristics which assure large energy delivery and corresponding force application to a stuck region of pipe.

At resonant conditions, a string of pipe will transmit power over its length to a load at the opposite end with the only loss being that necessary to overcome resistance in the form of damping or friction. In effect, power is transmitted in the same manner as the drilling process transmits rotary power to a bit, the difference being that the motion is axial translation instead of rotation. The load accepts the transmitted power as a large force acting through a small distance. Resonant vibration of pipe can deliver substantially higher sustained energy levels to a stuck tubular than any conventional method, including jarring. This achievement is due to the elimination of the need to accelerate or physically move the mass of the pipe string. Under resonant conditions, the power is applied to a vibrating string of pipe in phase with the natural movement of the pipe string.

When an elastic body is subjected to axial strain, as in the stretching of a length of pipe, the diameter of the body will contract. Similarly, when the length of pipe is compressed, its diameter will expand. Since a length of pipe undergoing vibration experiences alternate tensile and compressive forces as waves along the longitudinal axis (and therefore longitudinal strains), the pipe diameter will expand and contract in unison with the applied tensile and compressive waves. This means that for alternate moments during a vibration cycle the pipe may actually be physically free of its bond.

The term "fluidization" is used to describe the action of granular particles when excited by a vibrational source of proper frequency. Under this condition, granular material is transformed into a fluidic state that offers little resistance to movement of body through the media. In effect, it takes some of the characteristics and properties of a liquid. Accordingly, skin friction, that force that confines a stuck tubular, is reduced to a fraction of its normal value due to the effect of vibration because of alternate tensile and compressive forces applied to a pipe and to the fluidization of granular particles packed around the pipe.

Another factor in reducing stuck tubulars downhole is acceleration, wherein a suitable vibrational stroke may need to be only about an inch in order to produce good acceleration for friction reduction and fluidization. Accordingly, the vibrational energy received at the stuck area works to effect the release of a stuck member through the application of large percussive forces, fluidization of granular material, dilation and contraction of the pipe body and a reduction of well bore friction or hole drag.

Description of the Prior Art

Resonant vibration systems for use in oilfield tubular extraction applications consist of three basic components: a mechanical oscillator with a suspension device for isolating the rig or support structure, a work string for transmitting vibrational energy, and the stuck tubular or fish to be recovered. The oscillator generates an axial sinusoidal force that can be tuned to a given frequency within a specified operating range. The force generated by the oscillator acts on the work string to create axial vibration of the string. When tuned to a resonant frequency of the system, energy developed at the oscillator is efficiently transmitted to the stuck member with the only losses being those attributed to frictional resistance. The effect of the system reactance is completely eliminated because mass inductance is equal to spring capacitance at the resonant frequency. The total resonant system must be designed so that the components act in concert with one another, thus providing an efficient and effective extraction system.

In conventional coiled tubing operations one of the actions that is detrimental to the life of the coiled tubing is that of continually working the pipe to and from the tubing reel, back and forth over the well entry gooseneck. This action induces bending yield stress into the tubing, which results in accumulated fatigue damage and can eventually lead to fatigue failure of the tubing wall. Modern instrumentation allows monitoring of the tubing bending action and the coil service company will monitor and record that action so that the coil is not used beyond its useful life.

The principal of resonant axial vibration of pipe can be applied to coiled tubing without using the gooseneck equipment. Additionally, it has been found that the coiled tubing does not necessarily need to be cut when used with the downhole coiled tubing recovery apparatus of this invention, thus saving the cost of a reel of tubing, as well as maintaining and enabling good well control, along with the facility for circulating fluids into and from the well.

Various pipe recovery techniques are well known in the art. An early pipe recovery device is detailed in U.S. Pat. No. 2,340,959, dated Feb. 8, 1944, to P. E. Harth. The Harth device is characterized by a suitable electrical or mechanical vibrator which is inserted into the pipe to be removed, such that the vibrator may be activated to loosen the pipe downhole in the well and enable removal of the pipe. A well pipe vibrating apparatus is detailed in U.S. Pat. No. 2,641,927, dated Jun. 16, 1953, to D. B. Grabel, et al. The device includes a vibrating element and a motor-powered drive which is inserted in a well pipe to be loosened and removed, to effect vibration of the pipe and subsequent extraction of the pipe from the well. U.S. Pat. No. 2,730,176, dated Jan. 10, 1956, to W. K. J. Herbold, details a means for loosening pipes in underground borings. The apparatus includes a device arranged within a paramagnetic cylindrical body including a drill, a rod rotatably mounted within the body and a disc member secured to one end of the drill rod, the disc member having a mass which is substantially equally distributed around the axis of the drill rod to define a surface of revolution. A motor is provided for rotating the drill rod and a magnetic apparatus for forcing the disc member into physical contact with the inner walls of the body and into rolling contact with the inner surface of the pipe upon rotation of the drill rod, to loosen the pipe downhole. U.S. Pat. No. 2,972,380, dated Feb. 21, 1961, to A. G. Bodine, Jr., details an acoustic method and apparatus for moving objects held tightly within a surrounding medium. The device includes a vibratory output member of an acoustic wave generator attached to an acoustically-free portion of the stuck tubular. The method includes operating the generator at a resonant frequency to establish a velocity node adjacent to the stuck point and a velocity antinode at the coupling point adjacent to the generator, to loosen the stuck member from the well. U.S. Pat. No. 3,189,106, dated Jun. 15, 1965, to A. G. Bodine, Jr., details a sonic pile driver which utilizes a mechanical oscillator and a pile coupling device for coupling the oscillator body to a pile and applying vibrations of the pile to drive the pile into the ground. U.S. Pat. No. 3,500,908, dated Mar. 17, 1970, to D. S. Barler, details apparatus and method for freeing well pipe. The device includes a number of rotatable, powerdriven eccentrics which are connected to an elongated member such as a drill pipe that is stuck in an oil well bore hole and to a resiliently-movable support suspended from the traveling block of an oil derrick. When the power-driven eccentrics are operated, the elongated member is subjected to vertically-directed forces that free it from the stuck position. U.S. Pat. No. 4,429,743, dated Feb. 7, 1984, to Albert G. Bodine, details a well servicing system employing sonic energy transmitted down the pipe string. The sonic energy is generated by an orbiting mass oscillator coupled to a central stem, to which the piston of a cylinder-piston assembly is connected. The cylinder is suspended from a suitable suspension means such as a derrick, with the pipe string being suspended from the piston in an in-line relationship. The fluid in the cylinder affords compliant loading for the piston, while the fluid provides sufficiently high pressure to handle the load of the pipe string and any pulling force thereon. The sonic energy is coupled to the pipe string in the longitudinal vibration mode, which tends to maintain this energy along the string. U.S. Pat. No. 4,574,888 dated Mar. 11, 1986, to Wayne E. Vogen, details a "Method and Apparatus For Removing Stuck Portions of A Drill String". The lower end of an elastic steel column is attached to the upper end of the stuck element and the upper end of the column extends above the top of the well and is attached to a reaction mass lying vertically above, through an accelerometer and vertically-mounted compression springs in parallel with a vertically-mounted servo-controlled, hydraulic cylinder-piston assembly. Vertical vibration is applied to the upper end of the column to remove the stuck element from the well. A "Device For Facilitating the Release of Stuck Drill Collars" is detailed in U.S. Pat. No. 4,576,229, dated Mar. 18, 1986, to Robert L. Brown. The device includes a first member mounted with the drill pipe disposed in a first position and a second member concentrically mounted with a drill collar or drill pipes in a second position below the first position. Rotation of the drill string from the surface causes a camming action and vibration in a specified operative position of the device, which helps to free stuck portions of the drill pipe. U.S. Pat. No. 4,788,467, dated Nov. 29, 1988, to E. D. Plambeck details a downhole oil well vibrating apparatus that uses a transducer assembly spring chamber piston and spring to effect vibration of downhole tubulers. U.S. Pat. No. 5,234,056, dated Aug. 10, 1993, to Albert G. Bodine, details a "Sonic Method and Apparatus For Freeing A Stuck Drill String". The device includes a mechanical oscillator employing unbalanced rotors coupled to the top end of a drill string stuck in a bore hole. Operation of the unbalanced rotors at a selected frequency provides resonant vibration of the drill string to effect a reflected wave at the stuck point, resulting in an increased cyclic force at this point.

The prior art is well established regarding the application of vibration to stuck downhole tubulars of the conventional type (threaded pipe). There is no suggestion, however, of any means or method for handling continuous pipe such as coiled tubing, in a vibrational or any other application. It is thus an object of this invention to provide an apparatus and method for working coiled tubing in a stuck pipe or other downhole stuck equipment situation, wherein the coil may be raised and lowered in the well bore by a support structure that includes a lifting and lowering apparatus. Such movement of the coil is accomplished with substantially no bending of the coil string.

Another object of this invention to provide a new and improved downhole coiled tubing recovery apparatus and method for releasing and recovering coiled tubing and other objects stuck or jammed downhole in a well.

Yet another object of this invention is to provide a new and improved downhole coiled tubing recovery apparatus and method which operates utilizing resonant vibration in combination with a specially designed coiled tubing bail to facilitate the release of stuck or jammed coiled tubing from a well.

Another object of the invention is to provide a new and improved coiled tubing recovery apparatus that may be applied to a continuous length of coiled tubing without cutting the tubing, and operated to vibrate the coiled tubing and remove the coiled tubing and other objects from a stuck or jammed position in the well.

A still further object of this invention is to provide a new and improved downhole coiled tubing recovery apparatus which is characterized by specially designed coiled tubing bail adapted to receive a length of coiled tubing from a reel and direct the coiled tubing through an injector head into and from the well, the coiled tubing bail being attached directly to the rig or to an oscillator suspended from the rig for selectively vibrating the coiled tubing and removing the coiled tubing from a stuck or jammed condition in the well.

Still another object of this invention is to provide a downhole coiled tubing recovery apparatus which utilizes an oscillator for attachment to a length of coiled tubing and applying a resonant vibration directly to the coiled tubing for removing the coiled tubing from a stuck or jammed condition in a well.

Another object of this invention is to provide a downhole coiled tubing recovery apparatus and method, which apparatus is characterized by an oscillator suspended from a rig or other support structure and a coiled tubing bail attached to the oscillator for receiving a length of coiled tubing extending from a coiled tubing reel and directing the coiled tubing through an injector head into the well, such that the oscillator can be operated to vibrate the coiled tubing, typically at a resonant frequency, and remove the coiled tubing from a stuck or jammed condition in the well.

Yet another object of the invention is to provide a coiled tubing recovery apparatus and method which is designed to vibrate jammed or stuck coiled tubing and reduce the friction of tubing insertion and extraction in a well.

SUMMARY OF THE INVENTION

These and other objects of the invention are provided in new and improved coiled tubing recovery apparatus and method, which apparatus is characterized in a preferred embodiment by a specially designed coiled tubing bail suspended directly from a rig structure or from an oscillator that is further suspended from the travelling block or other supporting structural element of an oil derrick or rig. The method of this invention includes. directing the coiled tubing from a reel through a set of rod clamps in the coiled tubing bail and through an injector head, into the well bore. In the event of a stuck or jammed condition of the coiled tubing in the well bore, the coiled tubing bail can be lifted and/or the oscillator can be lifted and operated to apply resonant vibration through the coiled tubing bail and the coiled tubing to loosen the coiled tubing in the well hole.

BRIEF DESCRIPTION OF THE DRAWINGS

The invention will be better understood by reference to the accompanying drawings, wherein.

DESCRIPTION OF THE PREFERRED EMBODIMENTS

Figure 1:
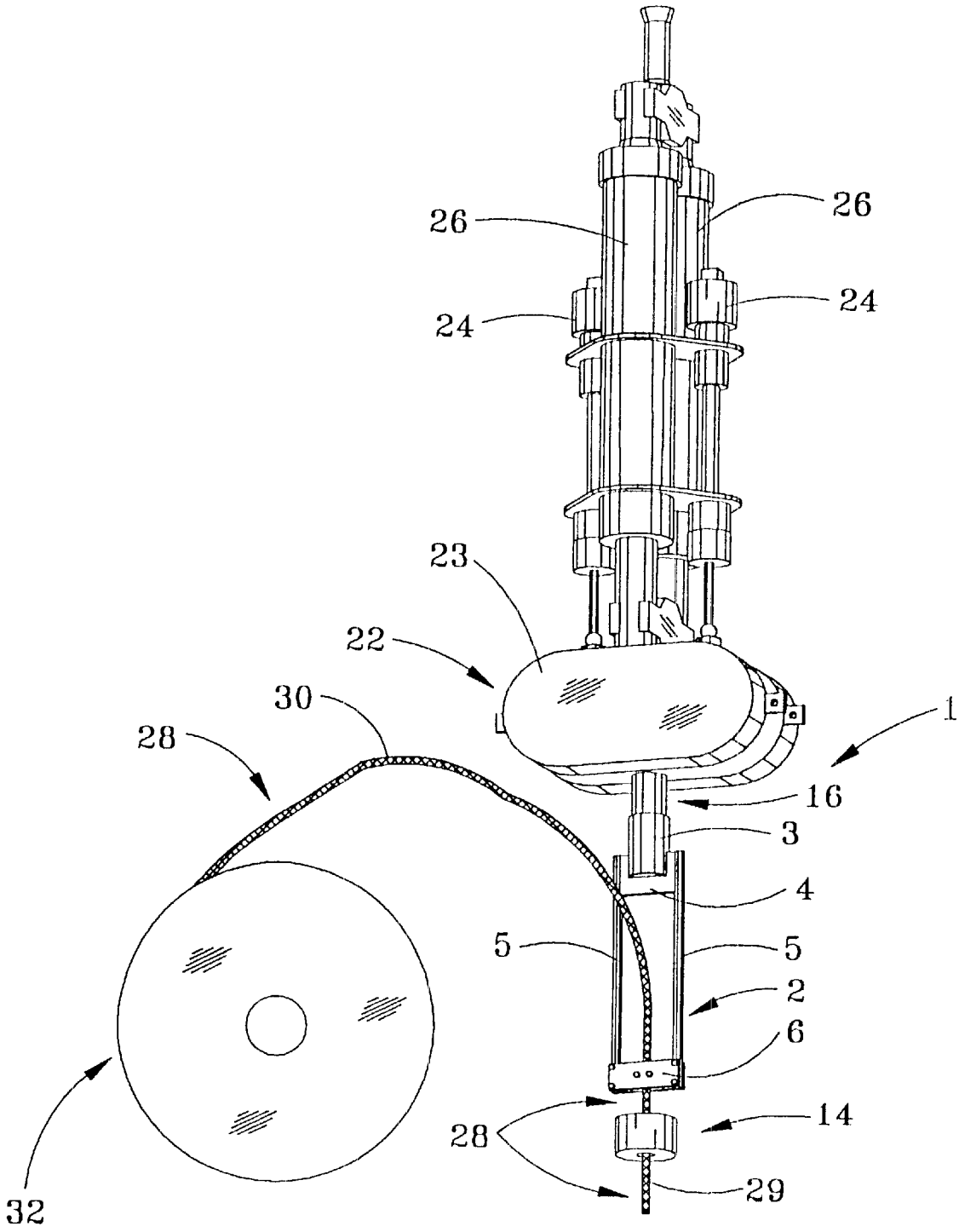
FIG. 1 is a perspective view of a typical coiled tubing oscillator and a bail element (rod clamps removed for brevity) of the downhole coiled tubing recovery apparatus of this invention, with a length of coiled tubing extending through the bail and into an injector head.
Figure 2:
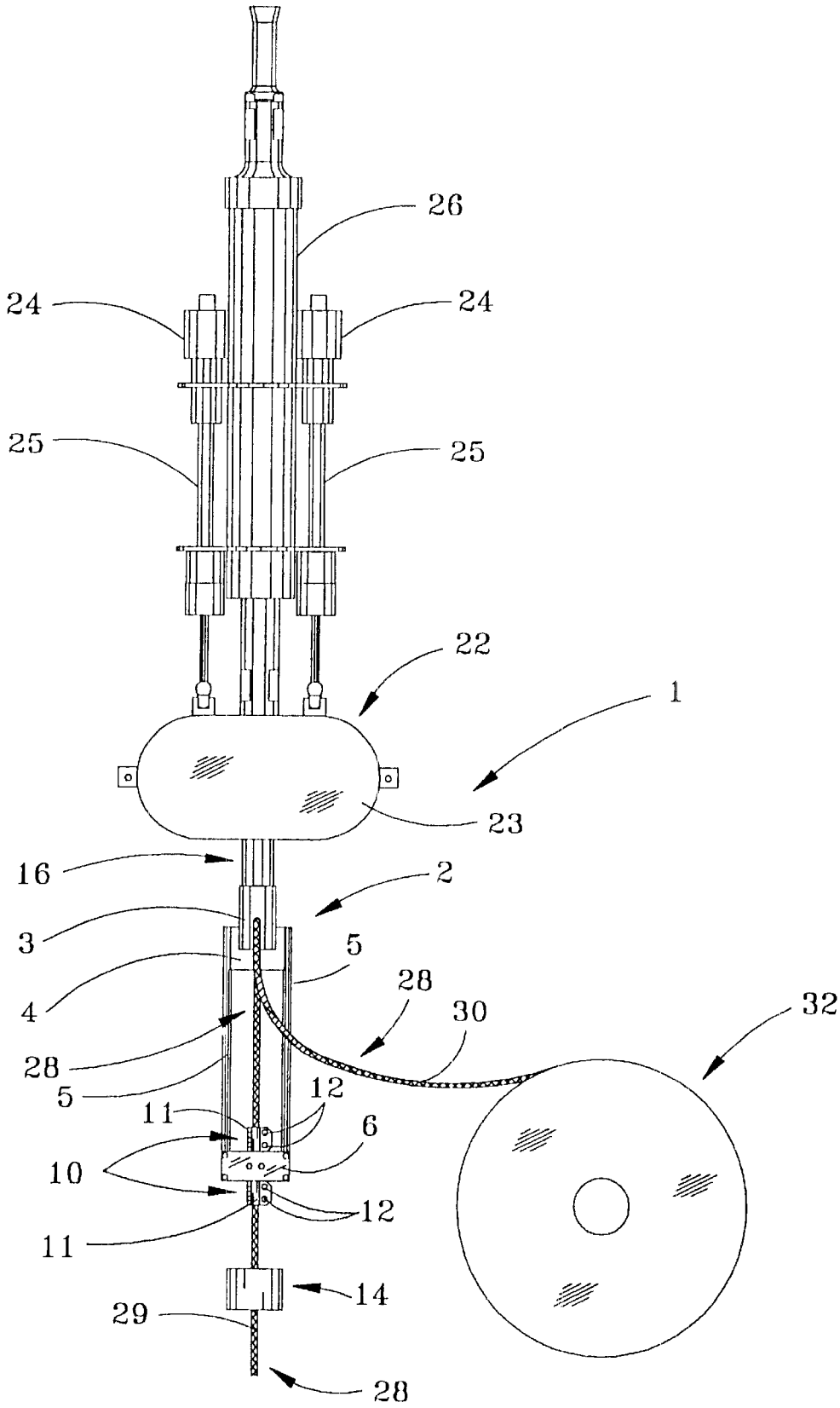
FIG. 2 is a front view of the coiled tubing oscillator and bail illustrated in FIG. 1.
Figure 6:
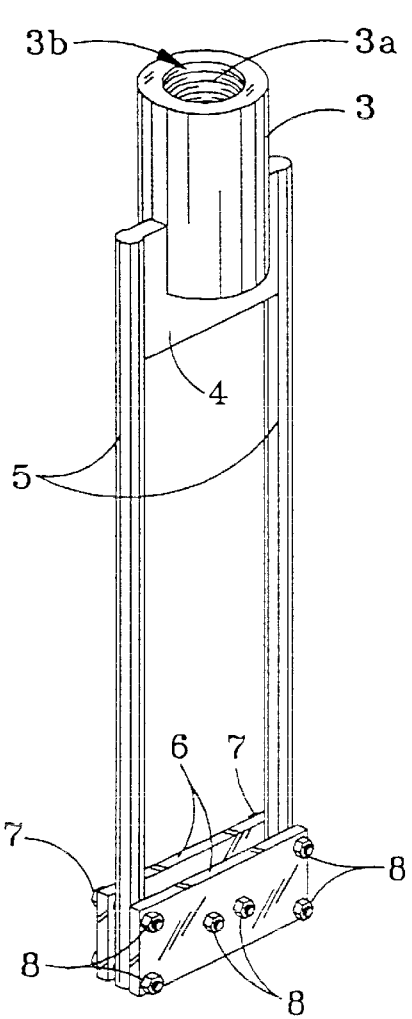
FIG. 6 is a perspective view of the coiled tubing bail illustrated in FIGS. 4 and 5.
Figure 5:
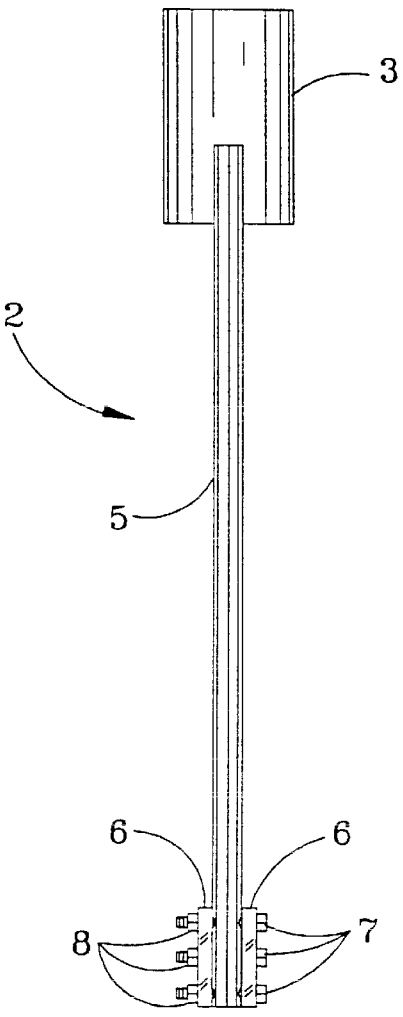
FIG. 5 is a side view of the coiled tubing bail illustrated in FIG. 4.
Figure 4:
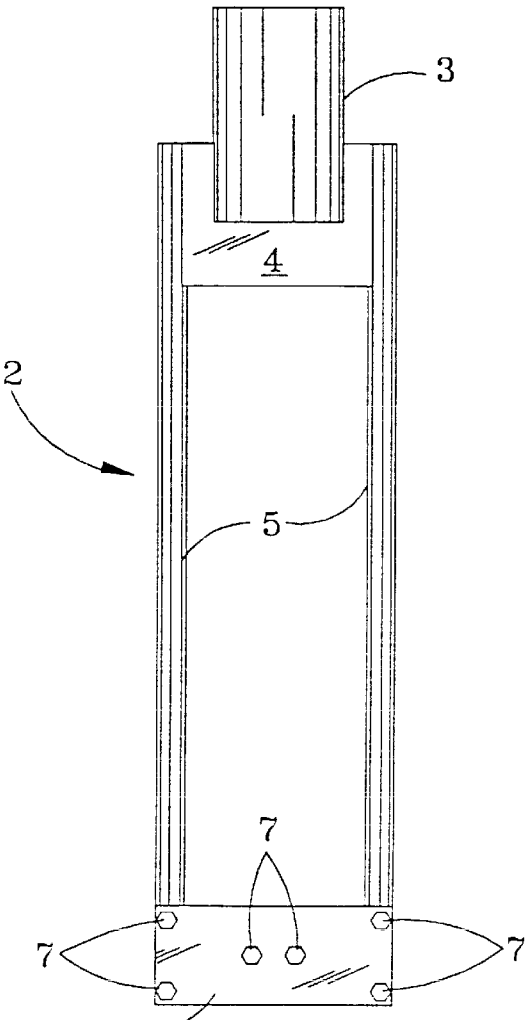
FIG. 4 is a front view of a preferred embodiment of the coiled tubing bail element of the downhole coiled tubing recovery apparatus of this invention.

Referring initially to FIGS. 1, 2 and 4–6 of the drawings, in a first preferred embodiment the coiled tubing recovery apparatus of this invention is generally illustrated by reference numeral 1. The coiled tubing recovery apparatus 1 includes a coiled tubing bail 2, more particularly illustrated in FIGS. 4–6, including a union connector 3 at the top end thereof, having a connector opening 3*a*, fitted with internal connector threads 3*b* (FIG. 6). A connector plate 4 joins a pair of vertically-oriented, parallel bail legs 5 at the union connector 3 and the bottom ends of the bail legs 5 are connected by means of a pair of parallel tubing plates 6, joined by plate bolts 7, secured by nuts 8, as further illustrated in FIGS. 4–6. In a most preferred embodiment, two sets of the plate bolts 7 extend through the respective bail legs 5, while another set of the plate bolts 7 extend in spaced-apart relationship with respect to each other near the center of the tubing plate 6, for accommodating the downhole segment 29 of a length of coiled tubing 28, as illustrated in FIGS. 1 and 2.

As further illustrated in FIGS. 1 and 2, the coiled tubing 28 is typically conventionally wound on a tubing reel 32, and is directed through the parallel bail legs 5, between the tubing plates 6 of the coiled tubing bail 2 and through one or more clamps, such as the conventional rod clamps 10, having clamp jaws 11, connected by jaw bolts 12, as further illustrated in FIG. 2. Accordingly, it will be appreciated from a consideration of FIGS. 1 and 2 that the coiled tubing 28 is characterized by a tubing reel segment 30, which is wound on the tubing reel 32 and extends from the tubing reel 32 to the coiled tubing bail 2, where a downhole segment 29 of the coiled tubing 28 projects through the rod clamps 10 and between the respective tubing plates 6, through an injector head 14 that usually serves to insert the coiled tubing 28 into a well bore (not illustrated) and remove the coiled tubing 28 from the well bore as desired, according to the knowledge of those skilled in the art.

Figure 7:
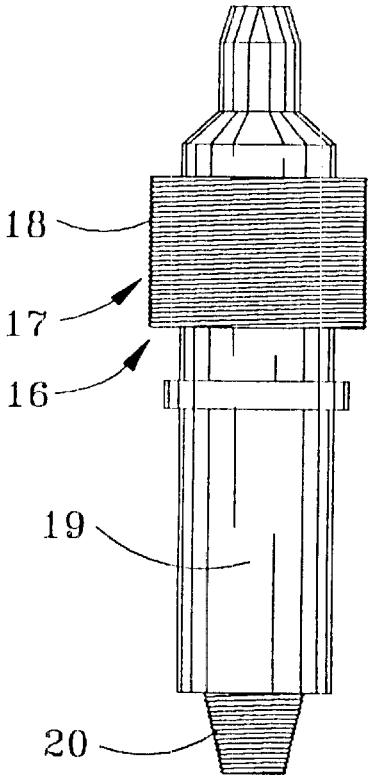
FIG. 7 is a front view of a typical union for connecting the length of coiled tubing to the oscillator in the embodiment of the invention illustrated in FIG. 3.

Referring again to FIGS. 1 and 2 of the drawings, the coiled tubing bail 2 is typically suspended from a conventional oscillator 22 at a union 16, detailed in FIG. 7. The union 16 is typically characterized by a top coupler 17, having exterior top coupler threads 18 that threadably engage the internal coupler threads (not illustrated) shaped in the oscillator 22. The bottom coupler threads 20 of the bottom coupler 19 engage the connector opening threads 3*b* in the connector opening 3*a* of the union connector 3, as further illustrated in FIG. 6. However, it will be appreciated by those skilled in the art that the coiled tubing bail 2 can be suspended from the oscillator 22 in other ways, such as by direct threaded attachment, slips and the like, as desired. The conventional oscillator 22 is typically characterized by an eccentric housing 23, which houses at least one pair of eccentrics (not illustrated) that are connected to the motor shafts 25 (FIG. 2) of a pair of eccentric drive motors 24. A spring housing 26 is positioned above the eccentric housing 23 for enclosing several springs (not illustrated) and isolating the vibration from the eccentrics located in the eccentric housing 23. The oscillator 22 is typically suspended from the travelling block or other element of an oil derrick or rig, (not illustrated), positioned over the well. Alternatively, the coiled tubing bail 2 can be attached directly to the travelling block or other component of the oil derrick or rig by means of threaded couplings, slips, or the like.

In operation according to the method of this invention, the downhole segment 29 of the coiled tubing 28 may be extended through the respective loosened clamp jaws 11 of the rod clamps 10, and between the parallel tubing plates 6, into the injector head 14, as illustrated in FIG. 1. When it is desired to extend or insert the downhole segment 29 of the coiled tubing 28 into the well, the injector head 14 is released from the downhole segment 29 and the coiled tubing bail 2 is raised and lowered, as necessary. Alternatively, the injector head 14 may be operated in conventional fashion to feed the coiled tubing 28 into the well. As the downhole segment 29 is fed into the well through the injector head 14, the tubing reel segment 30 of the coiled tubing 28 unwinds from the rotating tubing reel 32. It will be appreciated that during this procedure, the clamp jaws 11 of the rod clamps 10 are sufficiently slack by manipulation of the jaw bolts 12 to facilitate easy sliding movement of the coiled tubing 28 through the respective rod clamps 10 and between the tubing plates 6 and the spaced-apart inside ones of the plate bolts 7. Normal bottom hole operations utilizing the coiled tubing 28 can be effected upon completion of the insertion of the coiled tubing 28 into the well. However, under circumstances where the coiled tubing 28 gets stuck or jammed in the well due to well bore cave-in or other adverse downhole phenomena, retrieval of the coiled tubing 28 from the well bore can be achieved by operating the oscillator 22 to apply a vibration, typically at resonant frequency, to the coiled tubing bail 2 and the coiled tubing 28, attached to the coiled tubing bail 2, and release the coiled tubing 28 from the stuck or jammed condition in the well. In the course of applying a resonant frequency to the coiled tubing 28, the oscillator 22 generates an axial sinusoidal force that can be tuned to a specified frequency within the operating range of the oscillator 22. The force generated by the oscillator 22 acts on the coiled tubing 28 to create axial vibration of the downhole segment 29 of the coiled tubing 28. When tuned to a resonant frequency of the system, energy developed at the oscillator 22 is efficiently transmitted to the stuck downhole segment 29 of the coiled tubing 28, with the only losses being those attributed to frictional resistance. The effect of the coiled tubing 28 reactance is completely eliminated, because mass induction is equal to spring capacitance at the resonant frequency. Other aspects of the oscillator 22 operation is the fluidization of the granular particles downhole in the event that the cause of the stuck downhole segment 29 of the coiled tubing 28 results from a cave-in or silting of the hole or jamming of downhole objects to create a mechanical wedging action against the downhole segment 29 of the coiled tubing 28. When excited by a vibration from the oscillator 22, the granular particles are transformed into a fluidic state that offers little resistance to movement of the coiled tubing 28 upwardly or downwardly. In effect, the granular media takes on the characteristics and properties of a liquid and facilitates extraction of the downhole segment 29 of the coiled tubing 28 by elevating and/or lowering the coiled tubing 28 as described above.

Figure 3:
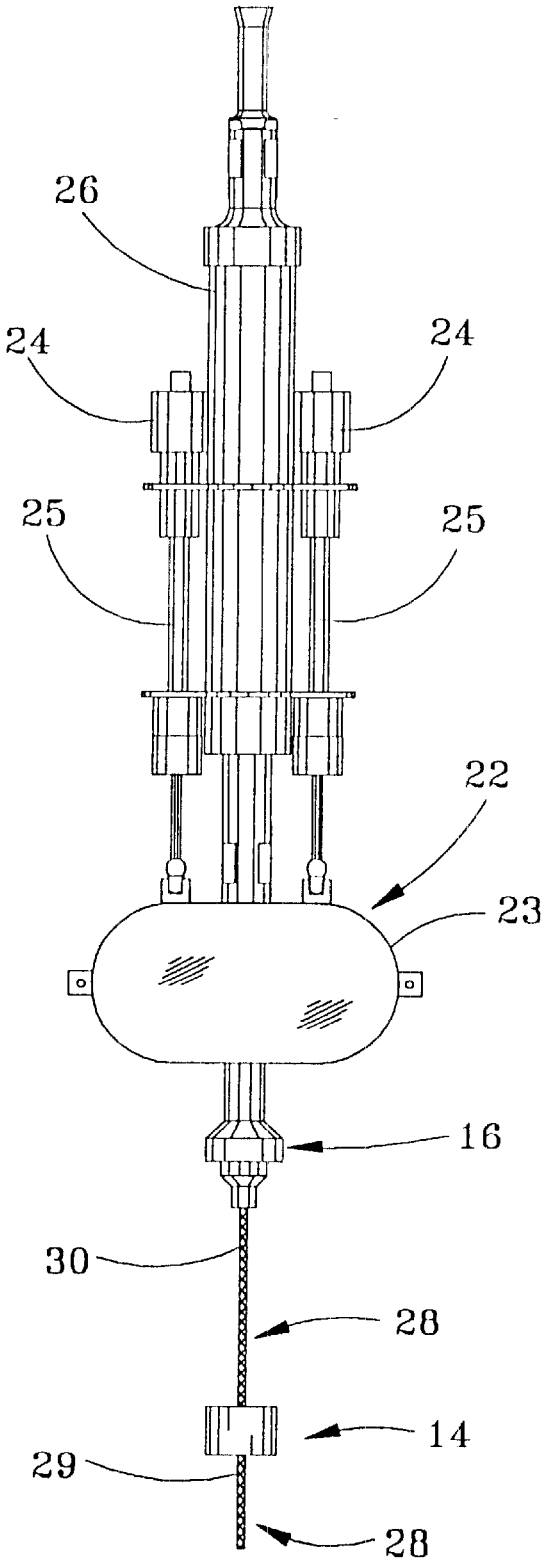
FIG. 3 is a front view of an alternative embodiment of the invention wherein a length of the coiled tubing is attached directly to the oscillator.

Referring now to FIG. 3 of the drawings, in another preferred embodiment of the invention the tubing reel segment 30 of the coiled tubing 28 may be cut and connected directly to the union 16 of the oscillator 22 to eliminate the coiled tubing bail 2. In this operation, the downhole segment 29 of the coiled tubing 28 may first be extended directly through the injector head 14 and conventionally, lowered into the well directly from the tubing reel 32 through the injector head 14, for commencement of downhole operations utilizing the coiled tubing 28. Under circumstances where the downhole segment 29 of the coiled tubing 28 becomes stuck or jammed in the well, the coiled tubing 28 is cut at a point above the injector head 14 and the tubing reel segment 30 attached to the union 16 by techniques known to those skilled in the art, and the oscillator 22 is then operated as described above, to free the coiled tubing 28 downhole. When the coiled tubing 28 is free, the upper end, or tubing reel segment 30 of the coiled tubing 28 is disconnected from the union 16 and the injector head 14 is reverse-operated to remove the coiled tubing 28 from the well, as described above. Alternatively, the coiled tubing bail 2 can be attached directly to the travelling block or other rig component as described above and the travelling block lifted to free the coiled tubing 28 from the well.

It will be appreciated by those skilled in the art that one of the advantages of the coiled tubing recovery apparatus and method of this invention is the facility for manipulating the coiled tubing 28 directly from the tubing reel 32 without the necessity of cutting the coiled tubing 28 in the embodiments illustrated in FIGS. 1, 2 and 4–6. Another advantage is the elimination of the conventional "gooseneck" equipment, which tends to degrade the coiled tubing 28 through multiple bends over the gooseneck as the coiled tubing 28 is inserted into and removed from the well by operation of the injector head 14.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A method for freeing coiled tubing in a well, comprising suspending a coiled tubing bail over the well; attaching the coiled tubing to the coiled tubing bail; and applying an upward force to the coiled tubing bail for removing the coiled tubing from the well.

2. The method according to claim 1 comprising attaching a vibrating apparatus to the coiled tubing bail and operating the vibrating apparatus to vibrate the coiled tubing bail and the coiled tubing in the well as the upward force is applied to the coiled tubing bail.

3. The method according to claim 2 wherein operating the vibrating apparatus comprises operating the vibrating apparatus at a resonant frequency.

4. The method according to claim 1 comprising lowering the coiled tubing bail for applying a compressive load on the coiled tubing prior to applying the upward force to the coiled tubing bail.

5. The method according to claim 4 comprising attaching a vibrating apparatus to the coiled tubing bail and operating the vibrating apparatus to vibrate the coiled tubing bail and the coiled tubing in the well as the upward force is applied to the coiled tubing bail.

6. The method according to claim 5 wherein operating the vibrating apparatus comprises operating the vibrating apparatus at a resonant frequency.

7. The method according to claim 1 comprising providing at least one clamp in association with the coiled tubing bail, extending the coiled tubing through the clamp and the coiled tubing bail and selectively clamping the coiled tubing in the coiled tubing bail for attaching the coiled tubing to the coiled tubing bail.

8. The method according to claim 7 comprising attaching a vibrating apparatus to the coiled tubing bail and operating the vibrating apparatus to vibrate the coiled tubing bail and the coiled tubing in the well as the upward force is applied to the coiled tubing bail.

9. The method according to claim 8 wherein operating the vibrating apparatus comprises operating the vibrating apparatus at a resonant frequency.

10. The method according to claim 7 comprising lowering the coiled tubing bail for applying a compressive load on the coiled tubing prior to applying the upward force to the coiled tubing bail.

11. The method according to claim 10 comprising attaching a vibrating apparatus to the coiled tubing bail and operating the vibrating apparatus to vibrate the coiled tubing bail and the coiled tubing in the well as the upward force is applied to the coiled tubing bail.

12. The method according to claim 11 wherein operating the vibrating apparatus comprises operating the vibrating apparatus at resonant frequency.

13. The method of claim 7 wherein said at least one clamp comprise a pair of clamps and comprising raising the coiled tubing bail and the clamps for exerting upward tension on the coiled tubing prior to lowering the coiled tubing bail and the clamps for exerting compression on the coiled tubing.

14. The method according to claim 13 comprising attaching a vibrating apparatus to the coiled tubing bail and operating the vibrating apparatus to vibrate the coiled tubing bail and the coiled tubing in the well as the upward force is applied to the coiled tubing bail.

15. The method according to claim 14 wherein operating the vibrating apparatus comprises operating the vibrating apparatus at a resonant frequency.

16. A method for freeing coiled tubing in a well, comprising suspending a coiled tubing bail over the well, said coiled tubing bail comprising a connector plate, a pair of bail legs extending from the connector plate in spaced-apart relationship with respect to each other and a pair of tubing plates spanning the bail legs, with the tubing plates spaced-apart to receive the coiled tubing therebetween; attaching the coiled tubing to the coiled tubing bail; and applying an upward force to the coiled tubing bail for removing the coiled tubing from the well.

17. The method according to claim 16 comprising attaching a vibrating apparatus to the connector plate of the coiled tubing bail and operating the vibrating apparatus to vibrate the coiled tubing bail and the coiled tubing in the well.

18. The method according to claim 17 wherein operating the vibrating apparatus comprises operating the vibrating apparatus at a resonant frequency.

19. The method according to claim 16 comprising lowering the coiled tubing bail and the vibrating apparatus for applying a compressive load on the coiled tubing prior to applying the upward force to the coiled tubing bail.

20. A method for freeing coiled tubing in a well having an injector head, comprising suspending a coiled tubing bail over the well; providing at least one clamp in the coiled tubing bail for selectively clamping the coiled tubing in the coiled tubing bail; extending the coiled tubing from a coiled tubing reel through the clamp, the coiled tubing bail and the injector head, into the well; tightening the clamp on the coiled tubing; releasing the injector head from the coiled tubing; and lowering and raising, respectively, the coiled tubing bail, the clamp and the coiled tubing in the well for removing the coiled tubing from the well.

* * * * *